US010732563B2

(12) United States Patent
Imanaka

(10) Patent No.: US 10,732,563 B2
(45) Date of Patent: Aug. 4, 2020

(54) CHARGING DEVICE, DRUM UNIT AND IMAGE FORMING APPARATUS

(71) Applicant: KYOCERA Document Solutions Inc., Osaka (JP)

(72) Inventor: Koichi Imanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/365,718

(22) Filed: Mar. 27, 2019

(65) Prior Publication Data

US 2019/0317446 A1 Oct. 17, 2019

(30) Foreign Application Priority Data

Apr. 11, 2018 (JP) ..... 2018-076319

(51) Int. Cl.
*G03G 21/16* (2006.01)
*G03G 15/02* (2006.01)

(52) U.S. Cl.
CPC ..... *G03G 21/1647* (2013.01); *G03G 15/0233* (2013.01)

(58) Field of Classification Search
CPC ..... G03G 15/0225; G03G 15/0233; G03G 2221/1606; G03G 2221/1869; G03G 2221/1654; G03G 2221/1684
See application file for complete search history.

(56) References Cited

U.S. PATENT DOCUMENTS 7,706,724 B2 * 4/2010 Kawakami ..... G03G 15/0233 399/174
2014/0147159 A1 * 5/2014 Nishiyama ..... G03G 21/1867 399/90
2015/0023699 A1 * 1/2015 Kato ..... G03G 15/0865 399/262
2015/0043940 A1 * 2/2015 Tsuji ..... G03G 15/0225 399/100

FOREIGN PATENT DOCUMENTS

JP H10-003204 A 1/1998

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

The charging device includes a charging roller, a bush and a case. The charging roller is configured to come into contact with or be close to a surface of an image carrier and configured to charge the surface of the image carrier. The bush is configured to support an end portion of the charging roller in a rotatable manner. To the case, the end portion of the charging roller is attached along a predetermined attachment direction by the bush. The case includes a pair of guide walls standing along the attachment direction so as to guide the bush. The bush includes a bearing part and a restriction part. The end portion of the charging roller is inserted into the bearing part. The pair of guide walls is put between the bearing part and the restriction part.

6 Claims, 12 Drawing Sheets

CHARGING DEVICE, DRUM UNIT AND IMAGE FORMING APPARATUS

INCORPORATION BY REFERENCE

This application is based on and claims the benefit of priority from Japanese Patent application No. 2018-076319, filed on Apr. 11, 2018, which is incorporated by reference in its entirety.

BACKGROUND

The present disclosure relates to a charging device having a charging roller configured to charge a surface of an image carrier, a drum unit and an image forming apparatus which are provided with the charging device.

In an image forming apparatus using an electrophotographic process, a charging device of a contact charging type is broadly put into practical use, in which a charging roller made of conductive material comes into contact with a surface of a photosensitive drum (an image carrier) and then voltage is applied between the photosensitive drum and the charging roller to charge the surface of the photosensitive drum.

The charging device of the contact charging type has sometimes a configuration that both end portion of the charging roller are supported by bearings in a rotatable manner and the bearings are biased toward the photosensitive drum by a pressing spring so as to bring the charging roller come into contact with the photosensitive drum. If the charging roller is displaced, a charged potential of the photosensitive drum is not uniform and an image failure may occur. Accordingly, the bearings are required to be positioned with a high precision.

Then, the charging device has a configuration that a pair of guide walls is formed in a casing and the bearings are guided between the guide walls. In such a configuration, because the guide walls have not sufficient strength and are easily deformed, the charging roller may be displaced. If the charging roller is displaced, the charged potential of the photosensitive drum is not uniform and an image failure may occur as described above.

SUMMARY

In accordance with an aspect of the present disclosure, a charging device includes a charging roller, a bush and a case. The charging roller is configured to come into contact with or be close to a surface of an image carrier and configured to charge the surface of the image carrier. The bush is configured to support an end portion of the charging roller in a rotatable manner. To the case, the end portion of the charging roller is attached along a predetermined attachment direction by the bush. The case includes a pair of guide walls standing along the attachment direction so as to guide the bush. The bush includes a bearing part and a restriction part. The end portion of the charging roller is inserted into the bearing part. The pair of guide walls is put between the bearing part and the restriction part.

In accordance with an aspect of the present disclosure, a drum unit includes the image carrier, the charging device and a casing. By the casing, the image carrier and the charging device are supported. The charging device is attached to the casing along a rotation axis direction of the image carrier while the bush is held at the temporary fixed position. Then, when the engagement of the claw with the restriction part is released, the bush is biased by the biasing member such that the charging roller comes into contact with or is close to the surface of the image carrier.

In accordance with an aspect of the invention, an image forming apparatus includes the drum unit and a toner image forming part configured to form a toner image on the image carrier.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus according to an embodiment of the present disclosure will be described.

Figure 1:
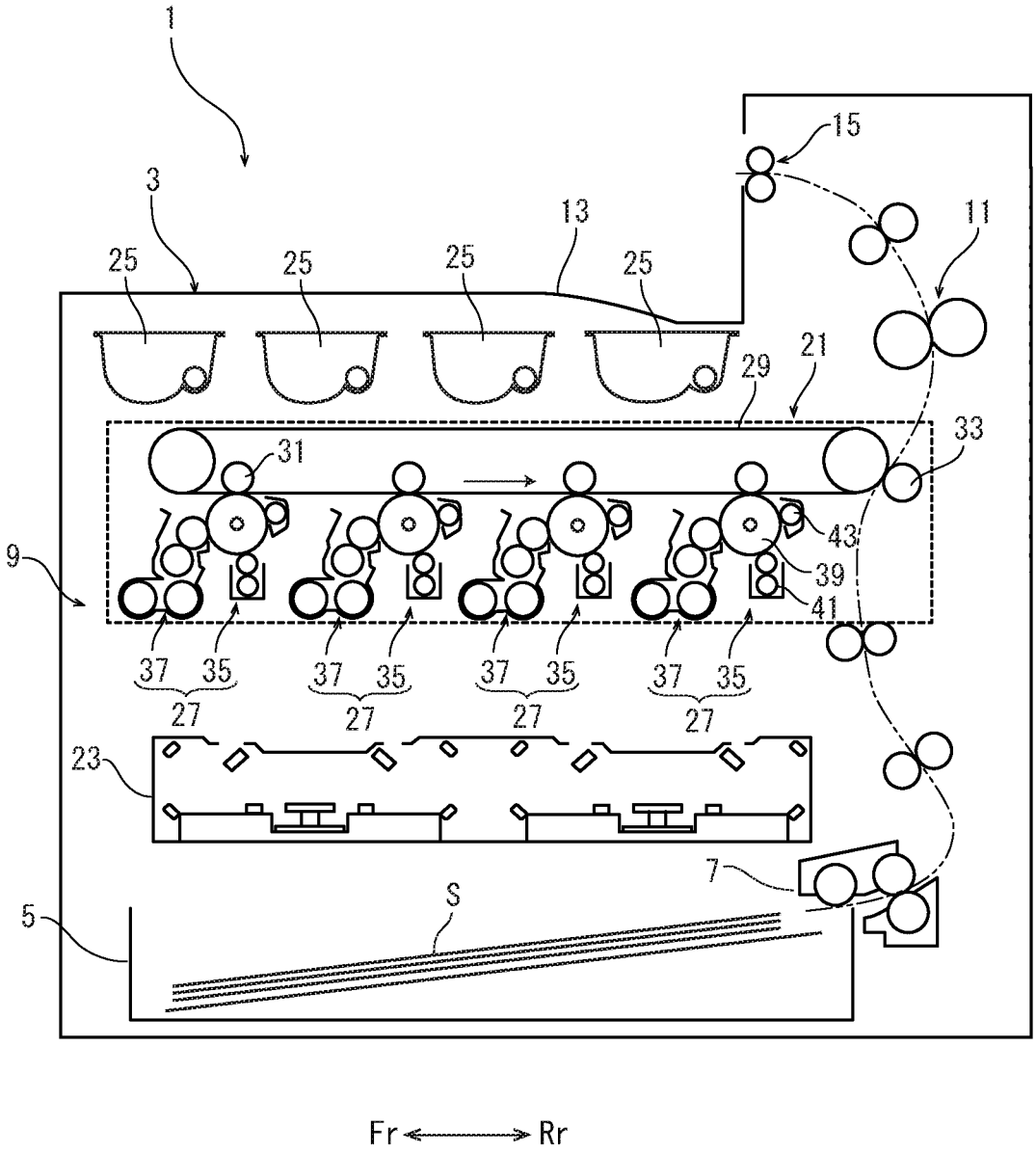
FIG. 1 is a side view showing an entire structure of a color printer according to an embodiment of the present disclosure.

First, with reference to FIG. 1, an entire structure of a color printer 1 as the image forming apparatus will be described. FIG. 1 is a front view showing an internal structure of the color printer. In the following description, a left side of a paper surface of FIG. 1 is defined to be a front side of the color printer 1, and "Fr", "Rr", "L", "R", "U" and "D" in each figure respectively indicates "a front side", "a rear side", "a left side", "a right side", "an upper side" and "a lower side" of the color printer 1.

An apparatus main body 3 of the color printer 1 is provided with a sheet feeding cassette 5 storing a sheet S, a sheet feeding device 7 feeding the sheet S from the sheet feeding cassette 5, a toner image forming part 9 forming a full color toner image on the sheet S, a fixing device 11 fixing the toner image on the sheet S, an ejecting device 15 ejecting the sheet S on which the toner image is fixed and an ejected sheet tray 13 on which the ejected sheet S is stacked. The apparatus main body 3 is further provided with a conveyance path 17 for the sheet S, which is formed so as to extend from the sheet feeding device 7 to the ejecting device 15 through the image forming part 9 and the fixing device 11.

The toner image forming part 9 includes an image forming part 21, an exposing device 23 and four toner containers 25.

The image forming part 21 includes four image forming units 27, an intermediate transferring belt 29, four primary transferring rollers 31 and a secondary transferring roller 33.

The four image forming units 27 correspond to four colors (yellow, magenta, cyan and black) of a toner (a developer), and each includes a drum unit 35 and a developing device 37. The drum unit 35 includes a rotatable photosensitive drum 39 as an image carrier, a charging device 41 and a cleaning device 43. The drum unit 35 will be described later. The four image forming units 27 are arranged in parallel along the left-and-right direction.

The intermediate transferring belt 29 is supported above the four image forming units 27 so as to circulate in a predetermined circulation direction (the counterclockwise direction in FIG. 1). The four primary transferring rollers 31 are disposed inside the intermediate transferring belt 29 and face the photosensitive drums 39 of the image forming units 27 via the intermediate transferring belt 29. The secondary transferring roller 33 is supported at the downstream side of the four image forming units 27 in the circulation direction of the intermediate transferring belt 29 so as to face the intermediate transferring belt 29.

The exposing device 23 emits laser light to the photosensitive drums 39 of the image forming units 27. The four toner containers 25 are connected to the corresponding developing devices 37.

Next, an image forming operation will be described. In the toner image forming part 9, the photosensitive drum 39 of each drum unit 35 is charged by the charging device 41, and then exposed by the exposing device 23 according to an image data to form an electrostatic latent image on the photosensitive drum 39. The electrostatic latent image is developed into a toner image by the developing device 37. The toner image is transferred by the primary transferring roller from the photosensitive drum 39 to the intermediate transferring belt 29. Thereby, a full color toner image is formed on the intermediate transferring belt 29. The full color toner image is transferred by the secondary transferring roller 33 from the intermediate transferring belt 29 to the sheet S. The toner remaining on the photosensitive drum 39 is removed by the cleaning device 43. The sheet on which the full color toner image is transferred is conveyed to the fixing device 11. The full color toner image is fixed on the sheet S by the fixing device 11. The sheet on which the full color toner image is fixed is ejected from the sheet ejecting device 15 and stacked on the ejected sheet tray 13.

Figure 2:
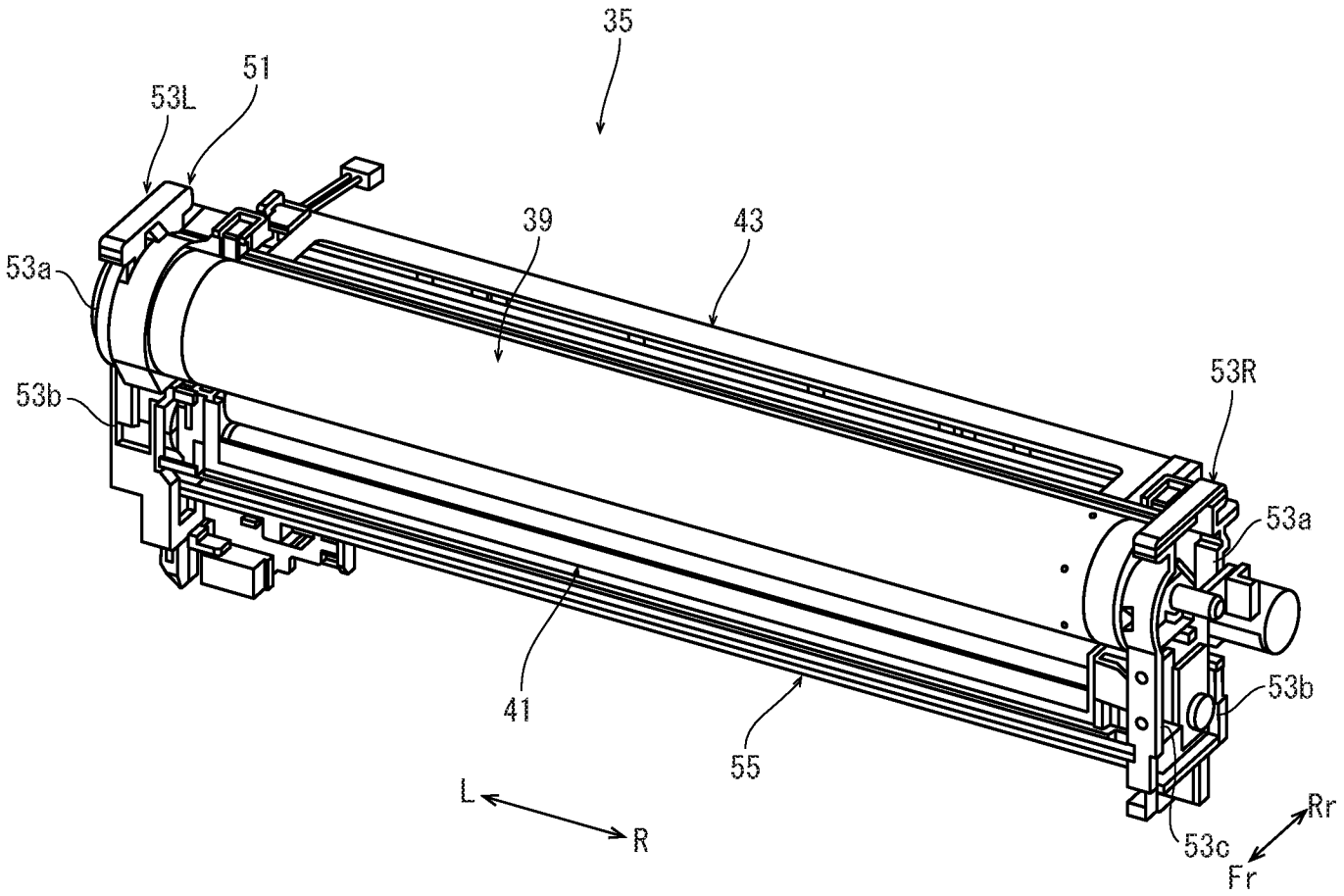
FIG. 2 is a perspective view showing a drum unit, in the color printer according to the embodiment of the present disclosure.
Figure 3:
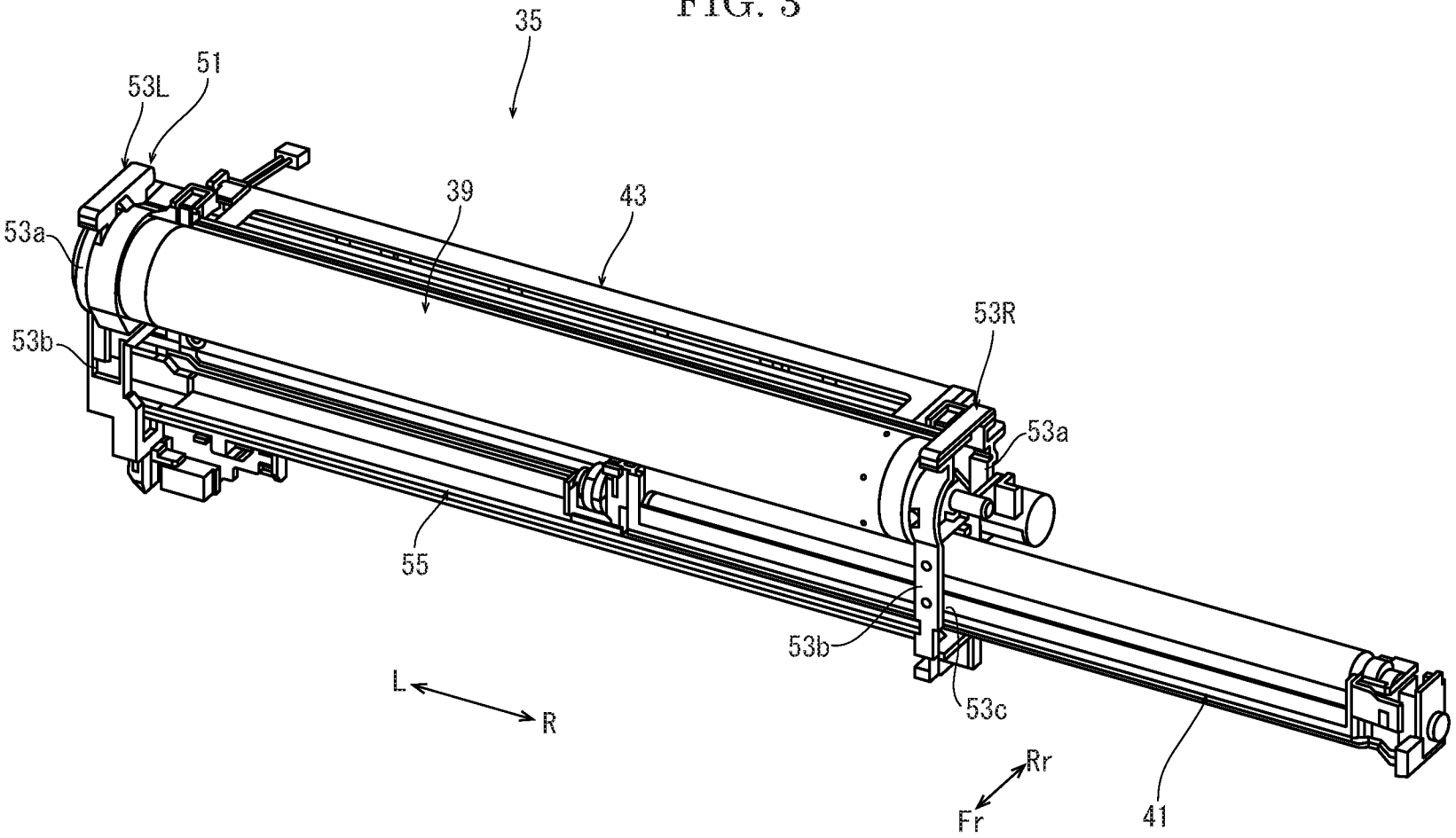
FIG. 3 is a perspective view showing the drum unit at the middle of an attachment process of a charging device, in the color printer according to the embodiment of the present disclosure.

Next, the drum unit 35 will be described with reference to FIG. 2 and FIG. 3. FIG. 2 is a perspective view showing the drum unit and FIG. 3 is a perspective view showing the drum unit at the middle of an attachment process of the charging device.

As described above, the drum unit 35 is a single unit in which the photosensitive drum 39, the charging device 41 and the cleaning device 43 are mounted in a casing 51.

The casing 51 has left and right side plates 53L and 53R and a rail plate 55. The left and right side plates 53L and 53R are disposed at a predetermined interval in an axial direction (the left-and-right direction) of a rotation shaft of the photosensitive drum 39. The rail plate 55 is bridged between the left and right side plates 53L and 53R.

The left and right side plates 53L and 53R each have a vertically long rectangular shape. In an upper half portion and a lower half portion of each side plate, an upper side supporting part 53*a* and a lower side supporting part 53*b* are respectively formed. To the upper side supporting part 53*a*, an end portion of the rotation shaft of the photosensitive drum 39 is supported. To the lower side supporting part 53*b*, an end portion of the charging device 41 is supported. The lower side supporting part 53*b* of the one side plate 53R (the right side plate) has an opening 53*c*.

The rail plate 55 is bridged between lower end portions of the lower side supporting parts 53*b* of the left and right side plates 53L and 53R along the axial direction of the photosensitive drum 39. A space surrounded by both the lower side supporting parts 53*b* and the rail plate 55 is communicated with the opening 53*c* of the right side plate 53R.

The photosensitive drum 39 is disposed between the upper side supporting parts 53*a* of the left and right side plates 53L and 53R, and both the end portions of the rotation shaft are supported by the upper side supporting parts 53*a* in a rotatable manner. The cleaning device 43 is disposed so as to face the surface of the photosensitive drum 39, and both end portions of the cleaning device 41 are fixed to side faces (rear side faces) of the upper side supporting parts 53*a*. The charging device 41 is disposed between the lower side supporting parts 53*b* of the left and right side plates 53L and 53R so as to face the surface of the photosensitive drum 39, and supported by both the lower side supporting parts 53*b* and the rail plate 55.

As shown in FIG. 3, the charging device 41 is inserted through the opening 53*c* of the lower side supporting part 53*b* of the right side plate 53R, slid along the rail plate 55 and then supported by both the lower side supporting parts 53*b* and the rail plate 55.

Figure 4:
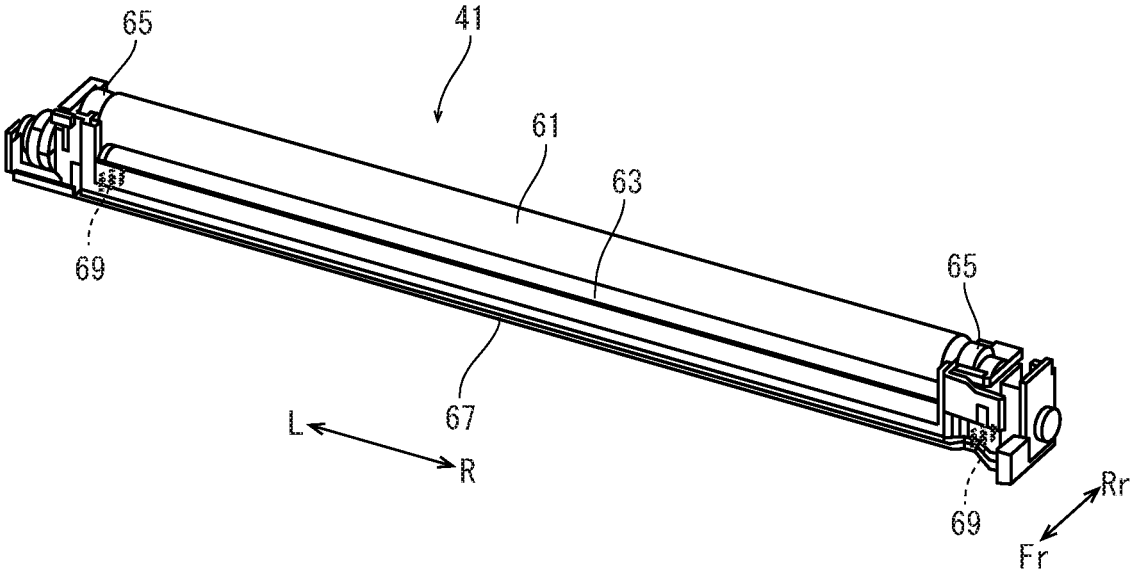
FIG. 4 is a perspective view showing the charging device according to the embodiment of the present disclosure.
Figure 5:
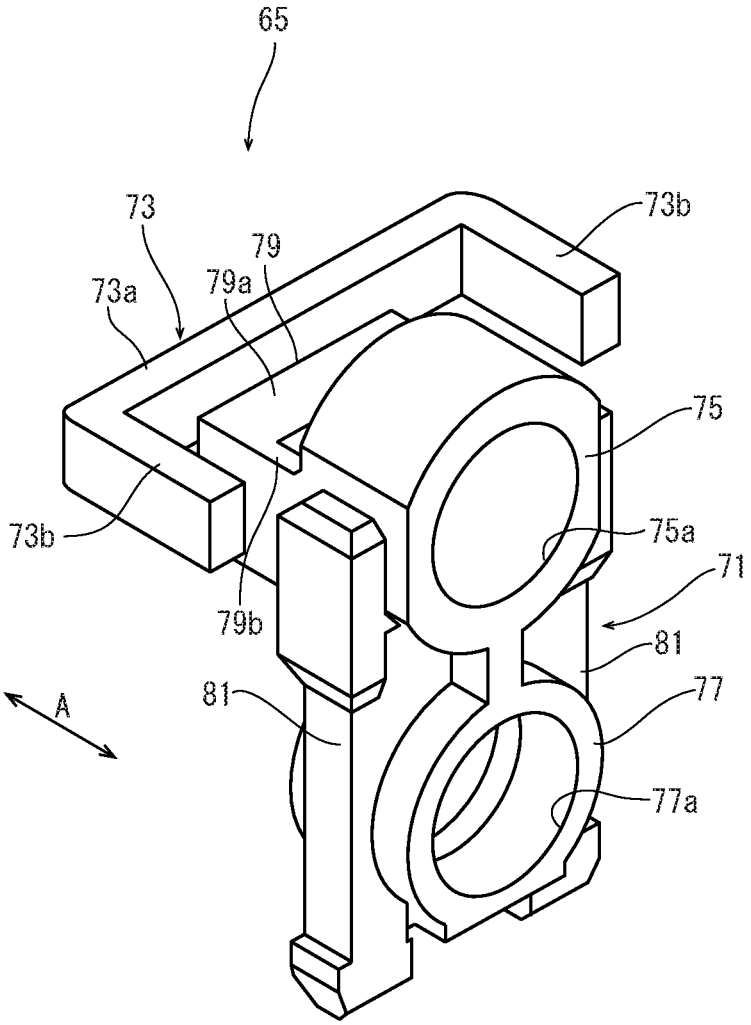
FIG. 5 is a perspective view showing a bush, in the charging device according to the embodiment of the present disclosure.

Next, the charging device 41 will be described with reference to FIG. 4. FIG. 4 is a perspective view showing the charging device.

The charging device 41 includes a charging roller 61, a cleaning roller 63, bushes 65, a case 67 and springs 69. The charging roller 61 is configured to come into contact with the surface of the photosensitive drum 39. The cleaning roller 63 cleans a surface of the charging roller 61. The bush 65 is configured to support one end portion of the charging roller 61 and one end portion of the cleaning roller 63. To the case 67, the bushes 65 are attached. The springs 69 are an example of a biasing member biasing the bushes 65 such that the charging roller 61 comes into contact with the surface of the photosensitive drum 39.

The charging roller 61 includes a rotation shaft and a roller body. The roller body is made of electric conductive elastic material. By applying a predetermined voltage between the charging roller 61 and the photosensitive drum 39, the photosensitive drum 39 is charged to a predetermined potential.

The cleaning roller 63 includes a rotation shaft and a roller body. The roller body is made of sponge-like rubber, resin or elastically deformable pad such as synthetic fiber felt. Alternately, the cleaning roller 63 may be a brush roller in which a brush bristle is planted around a circumference of the rotation shaft.

Figure 6:
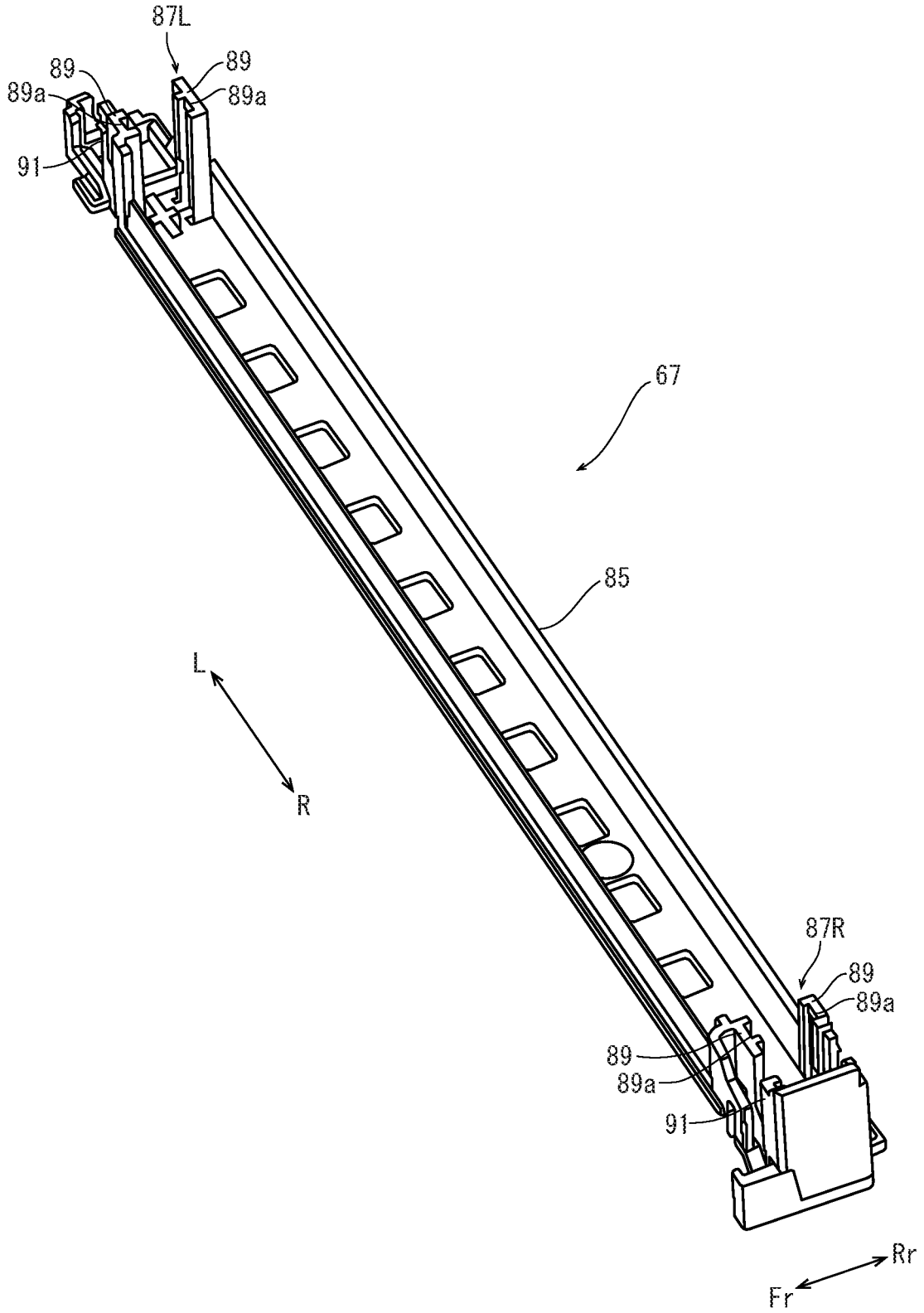
FIG. 6 is a perspective view showing a case, in the charging device according to the embodiment of the present disclosure.

The bush 65 will be described with reference to FIG. 6. FIG. 6 is a perspective view showing the bush.

The bush 65 is configured to support the end portion of the rotation shaft of the charging roller 61 and the end portion of the rotation shaft of the cleaning roller 63, and includes a bearing part 71 and a restriction part 73 integrally formed with the bearing part 71.

The bearing part 71 has upper and lower supporting parts 75 and 77, a fixed part 79 and a pair of guide parts 81.

The upper supporting part 75 is formed into a cylindrical shape having an axial hole 75*a* through which the end portion of the rotation shaft of the charging roller 61 is insertable. The lower supporting part 77 is formed into a cylindrical shape having an axial hole 77*a* through which the end portion of the rotation shaft of the cleaning roller 63 is insertable. The upper and lower supporting parts 75 and 77 are aligned in the upper-and-lower direction such that the axial holes 75*a* and 77*a* are parallel to each other, and integrally formed.

The fixed part 79 is formed in an approximately U-shape when viewed form the upper side, and has a fixed piece 79*a* and connection pieces 79*b* bent at right angles from both end portions of the fixed piece 79*a*. The connection pieces 79*b* are connected to the upper supporting part 75 at both sides of the axial hole 75*a*. The fixed piece 79*a* is slightly separated from the upper supporting part 75 in an axial direction A of the axial hole 75*a* across the axial hole 75*a*.

The guide parts 81 are formed on both sides of the upper and lower supporting parts 75 and 77 (both sides in a direction perpendicular to the axial direction A) along the upper-and-lower direction.

The restriction part 73 is formed in an approximately U-shape when viewed form the upper side, and has a base piece 73*a* and arm pieces 73*b* bent at right angles from both end portions of the base piece 73*a*. The base piece 73*a* is fixed to the fixed piece 79*a* of the fixed part 79 of the bearing part 71. The arm pieces 73*b* are disposed on both sides of the connection pieces 79*b* in the direction perpendicular to the axial direction A, and face the connection pieces 79*b* via a predetermined interval.

Next, the case 67 will be described with reference to FIG. 6, FIG. 7A and FIG. 7B. FIG. 6 is a perspective view showing the case, FIG. 7A and FIG. 7B are perspective views respectively showing left and right end portions of the case.

The case 67 includes a main body part 85 and left and right guide parts 87L and 87R. The main body part 85 is formed along an axial direction (the left-and-right direction) of the rotation shaft of the charging roller 61. The left and right guide parts 87L and 87R are provided at left and right end portions of the main body part 85.

The main body part 85 is formed in an approximately U shape whose upper face is opened. In a bottom wall of the main body part 85, openings are formed at intervals in the axial direction.

Figure 7A:
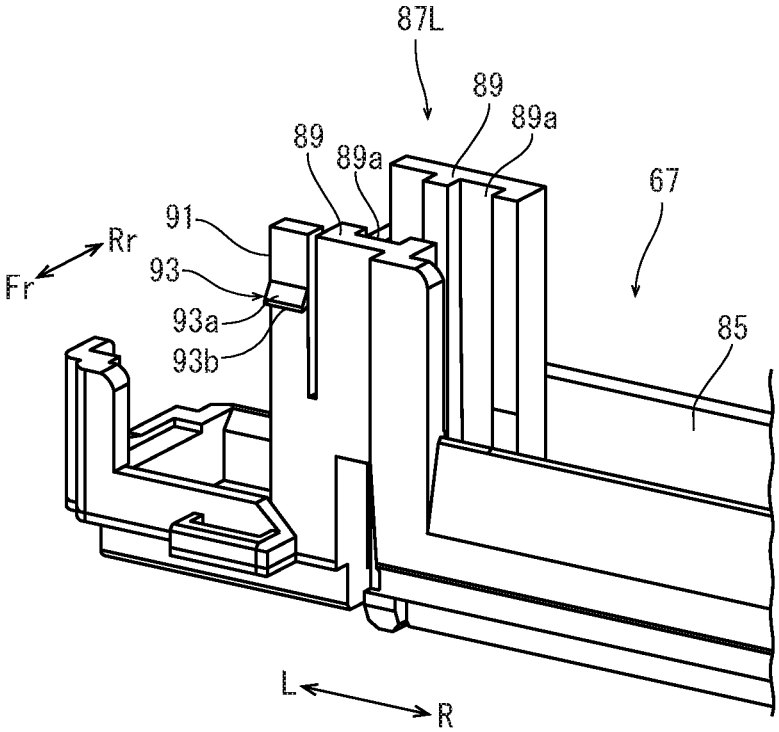
FIG. 7A is a perspective view showing a left end portion of the case, in the charging device according to the embodiment of the present disclosure.
Figure 7B:
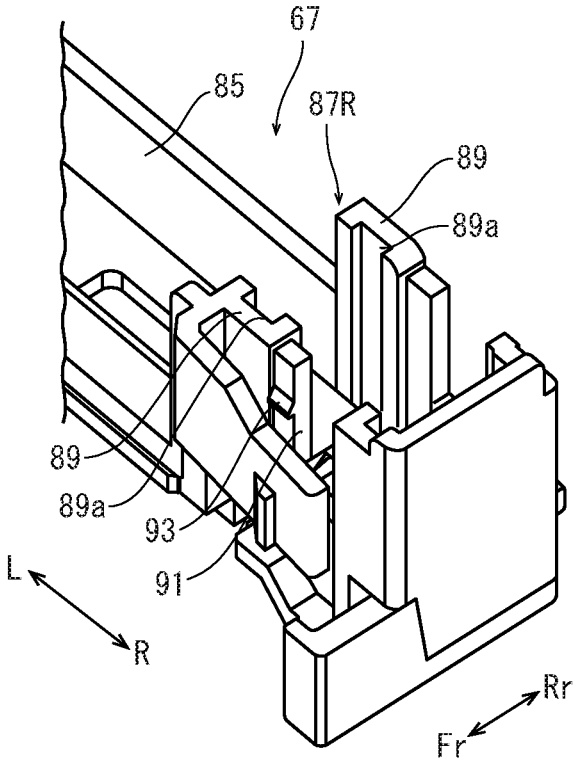
FIG. 7B is a perspective view showing a right end portion of the case, in the charging device according to the embodiment of the present disclosure.

As shown in FIG. 7A and FIG. 7B, the left and right guide parts 87L and 87R each have a pair of guide walls 89. The guide walls 89 face each other via a predetermined interval in a direction perpendicular to the axial direction of the charging roller 61 (hereinafter, called the front-and-rear direction), and are stood on the bottom wall of the main body part 85 almost at right angles. On opposing faces of the guide walls 89, guide grooves 89*a* are formed along the upper-and-lower direction.

One of the guide walls 89 (the front side guide wall 89) is formed integrally with a holding piece 91. The holding piece 91 is disposed outside the guide wall 89 in the axial direction of the charging roller 61, and formed to be almost at right angles to the bottom wall of the main body part 85. The holding piece 91 is elastically deformable in the front-and-rear direction with respect to the guide wall 89. On an outer face (a front face) of the holding piece 91 in the front-and-rear direction, a claw 93 is protruded from the center portion in the upper-and-lower direction. The claw 93 has an inclined wall 93*a* inclined in an oblique lower direction from the outer face of the holding piece 91 and a lower wall 93*b* perpendicular to the outer face of the holding piece 91. The holding piece 91 may be directly stood on the bottom wall of the main body part 85 almost at right angles.

The spring 69 is disposed between the guide walls 89 of the left and right guide parts 87L and 87R of the case 67, and supported on the bottom wall of the main body part 85 in a posture in which its biasing direction is along the upper-and-lower direction.

Figure 8:
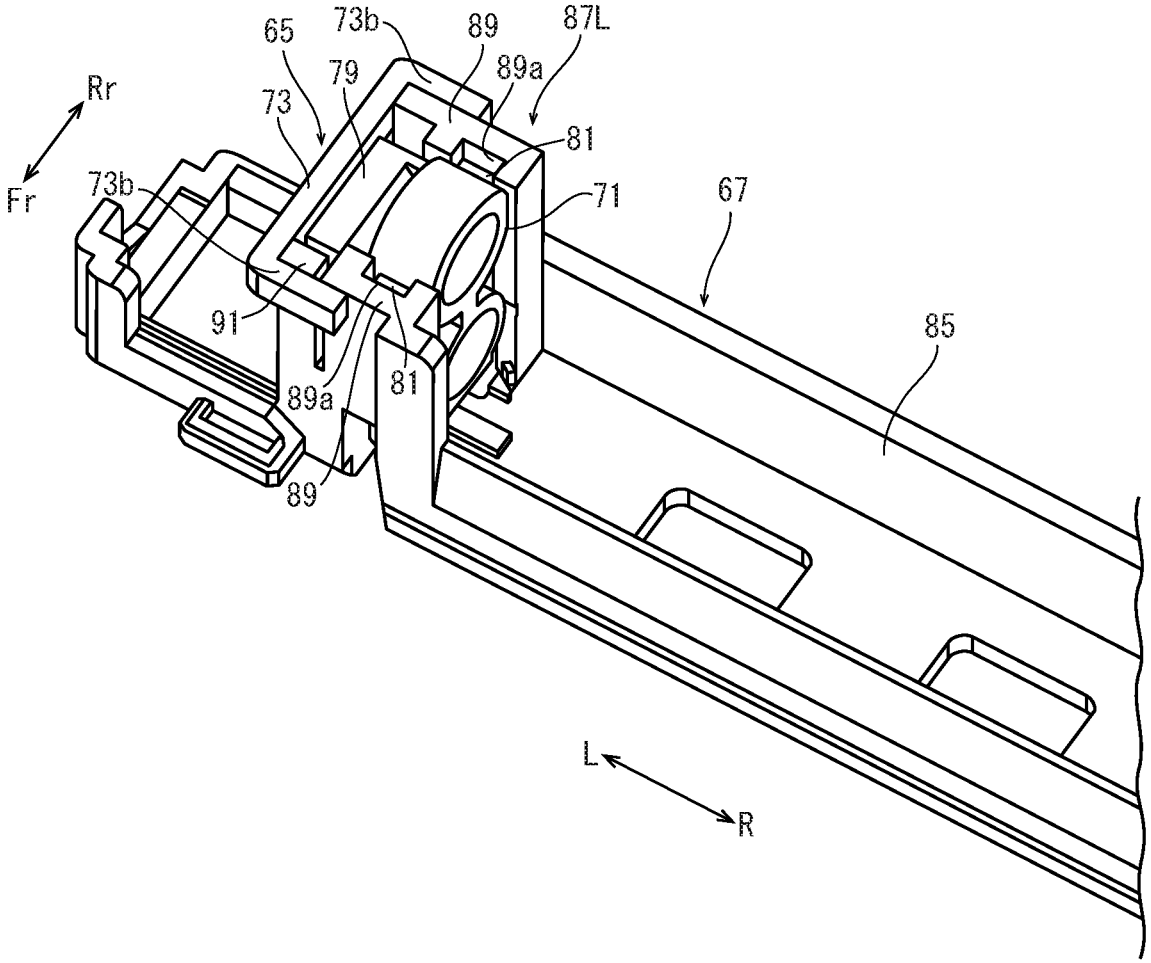
FIG. 8 is a perspective view showing the bush attached to a left guide part, in the charging device according to the embodiment of the present disclosure.
Figure 9:
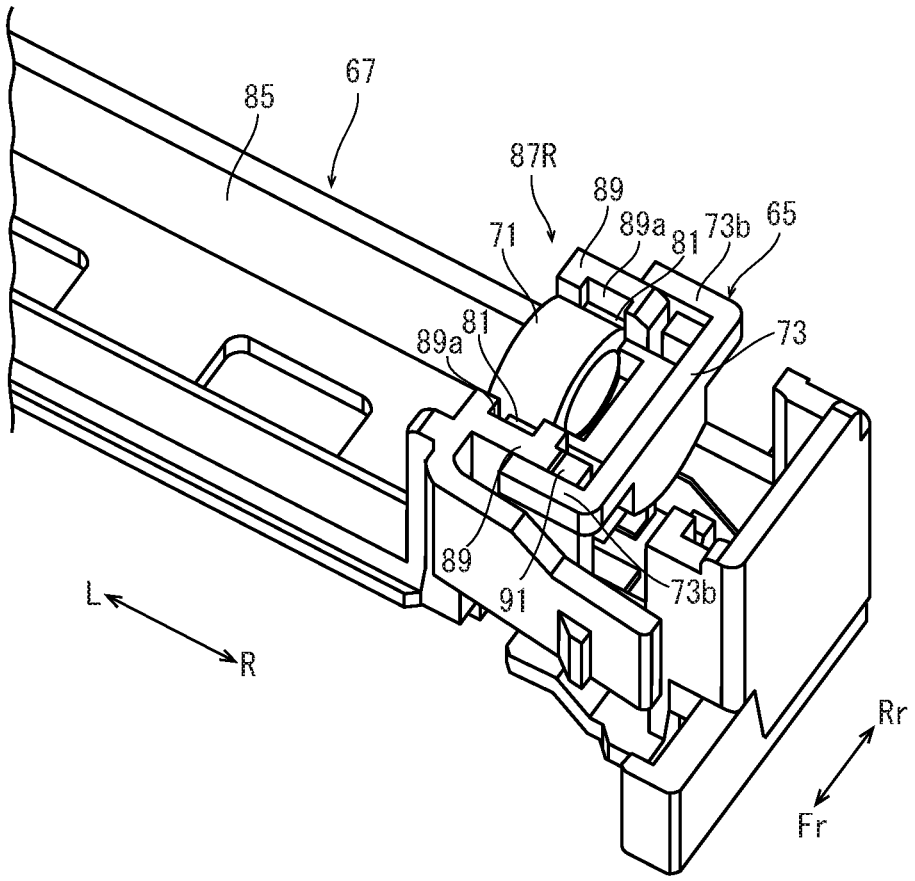
FIG. 9 is a perspective view showing the bush attached to a right guide part, in the charging device according to the embodiment of the present disclosure.
Figure 10:
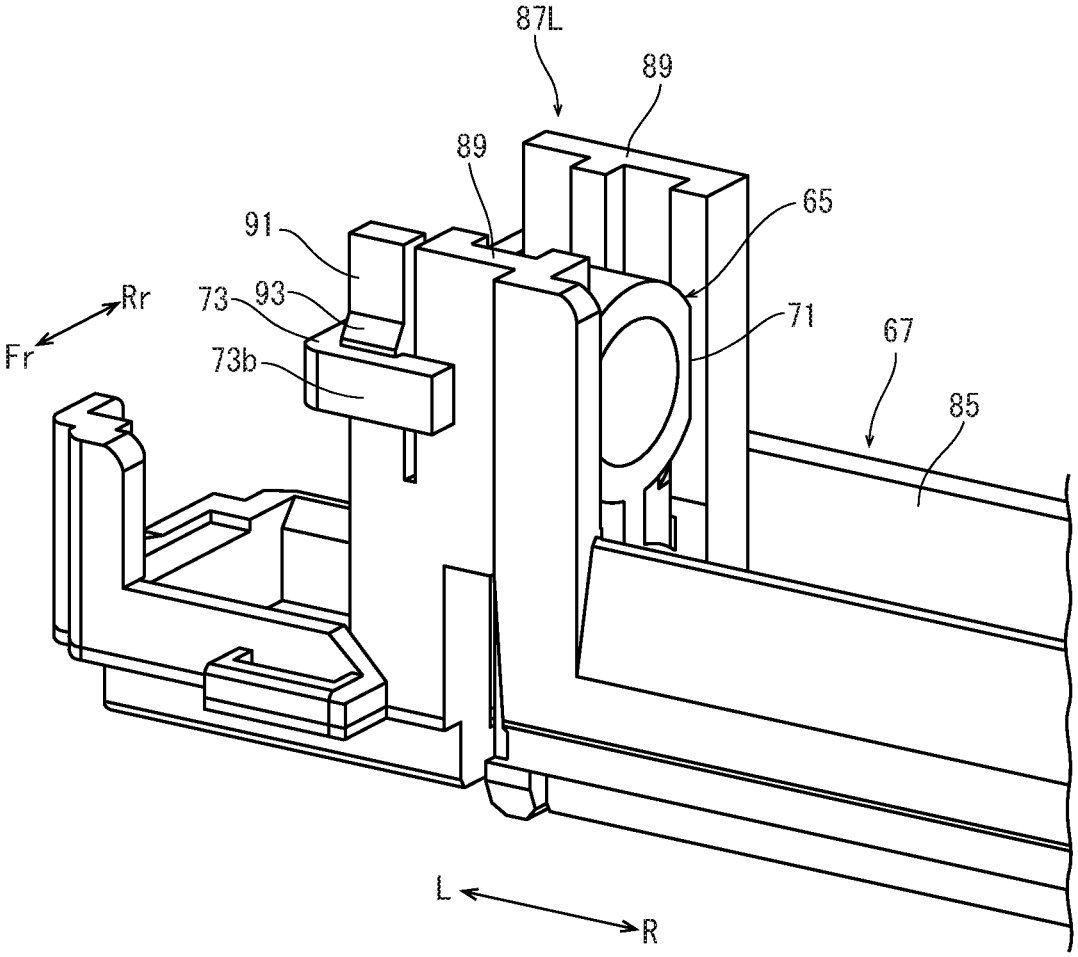
FIG. 10 is a perspective view showing the bush temporarily fixed to the left guide part, in the charging device according to the embodiment of the present disclosure.
Figure 11:
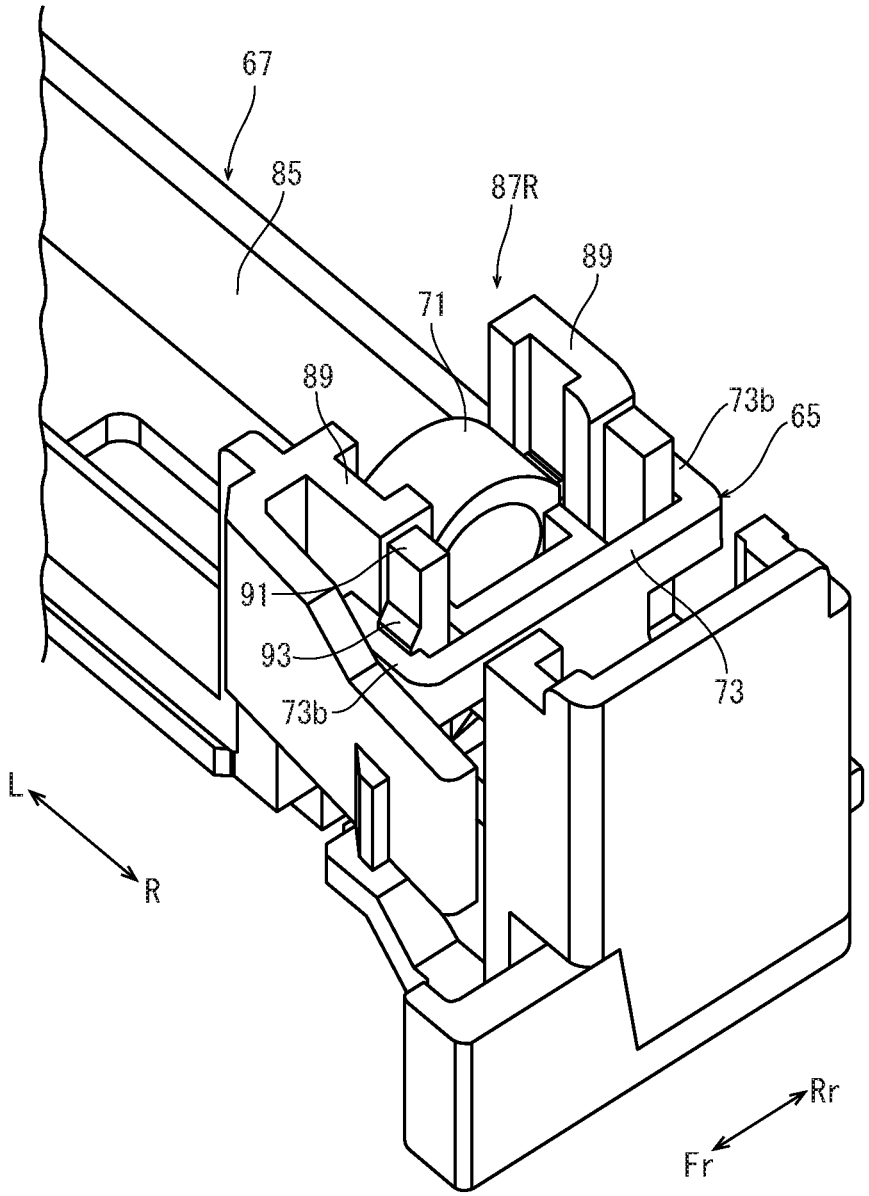
FIG. 11 is a perspective view showing the bush temporarily fixed to the right guide part, in the charging device according to the embodiment of the present disclosure.
Figure 12:
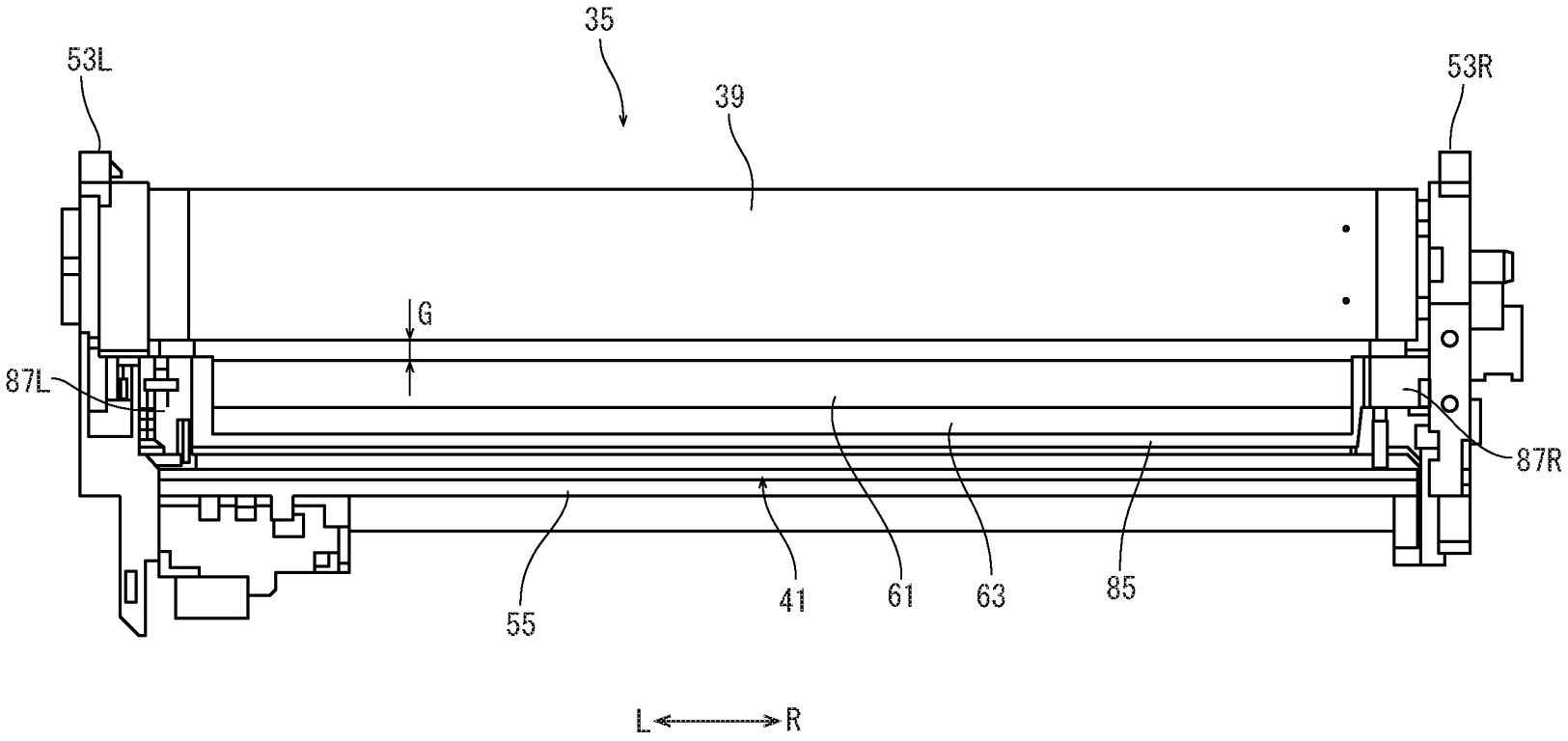
FIG. 12 is a front view showing the charging device to which the bushes are temporarily fixed and a photosensitive drum, in the color printer according to the embodiment of the present disclosure.

Next, an assembling way of the charging device 41 having the above configuration and an attachment process of the charging device 41 to the casing 51 of the drum unit 35 will be described with reference to FIG. 8 to FIG. 12. FIG. 8 and FIG. 9 are views showing the bush attached between the guide walls, FIG. 10 and FIG. 11 are views showing the bush temporarily fixed, and FIG. 12 is a front view showing the charging device to which the bush is temporarily fixed and the photosensitive drum. The charging roller and the cleaning roller are not shown in FIG. 8 to FIG. 11.

First, both the end portions of the rotation shaft of the charging roller 61 are inserted into the axial holes 75*a* of the upper side supporting parts 75 of the bearing parts 71 of the bushes 65, and both the end portions of the rotation shaft of the cleaning roller 63 are inserted into the axial holes 77*a* of the lower side supporting parts 77 of the bearing parts 71 of the bushes 65. Then, the bushes 65 are attached between the guide walls 89 of the left and right guide parts 87L and 87R of the case 67 along the upper-and lower direction from the upper side. That is, the charging roller 61 is attached and detached to and from the case 67 along the upper-and-lower direction (the attachment and detachment direction of the charging roller 61 is the upper-and-lower direction). At this time, as shown in FIG. 8 and FIG. 9, the guide parts 81 of the bush 65 are engaged with the guide grooves 89*a* of the guide walls 89, and the guide walls 89 and the holding piece 91 are put between the both the arm pieces 73*b* of the restriction part 73 and the bearing part 71 (the connection pieces 79*b* of the fixed part 79, mainly) of the bush 65.

Next, the bushes 65 are pushed downward. Then, the guide parts 81 are guided along the guide grooves 89*a*, and each bush 65 is lowered with the guide walls 89 and the holding piece 91 put between both the arm pieces 73*b* and the bearing part 71. Further, the springs 69 begin to be compressed by the bushes 65, and the bushes 65 begin to be applied with upward biasing force.

When the bushes 65 are pushed downward against the biasing force of the springs 69, the arm pieces 73*b* reach the claws 93 of the holding pieces 91, and are lowered along the inclined walls 93*a* of the claws 93. Then, each holding piece 91 is pushed inwardly by the arm piece 73*b* and begins to be elastically deformed. When the bushes 65 are pushed downward further and the arm pieces 73*b* are passed through the claws 93, the force to push the claws 93 inwardly is released to return the holding pieces 91 into the original upright posture. Then, as shown in FIG. 10 and FIG. 11, the claws 93 are engaged with the arm pieces 73*b*. By the arm pieces 73*b* engaged with the claws 93, the bushes 65 are temporarily fixed to the case 67 against the biasing force of the springs 69. At the temporary fixed position, the uppermost height of the charging roller 61 is almost the same as the uppermost height of the bushes 65.

Next, as shown in FIG. 3, the case 67 to which the bushes 65 are temporarily fixed are inserted through the opening 53*c* of the lower side supporting part 53*b* of the right side plate 53R of the drum unit 35, and then slid on the rail plate 55.

When the entire of the case 67 is supported on the rail plate 55, a stopper (not shown) of the case 67 is engaged with the right side plate 53R, and the case 67 is attached to the rail plate 55. In the state, as shown in FIG. 12, a predetermined gap G is formed between the uppermost surfaces of the charging roller 61 and the bushes 65, and the lowermost surface of the photosensitive drum 39. That is, the temporary fixed position (the position of the claw 93 of the holding piece 91) is previously set such that the predetermined gap G is formed between the charging roller 61, which is supported by the bushes 65 fixed temporarily, and the photosensitive drum 39, in the state where the case 67 is attached to the rail plate 55.

After that, the holding pieces 91 are elastically deformed inwardly manually. Then, the claws 93 of the holding pieces 91 separate from the arm pieces 73*b* of the bushes 65, and the engagement of the claws 93 with the arm pieces 73*b* are released. Then, the bushes 65 are biased upward by the springs 69 while the guide parts 81 guided along the guide grooves 89*a*. Then, the charging roller 61 comes into with the photosensitive drum 39. That is, the charging device 41 is assembled and then attached to the casing 51. Because the holding piece 91 is formed in the guide wall 89 at the one side (the front side), that is, the opposite side to the cleaning device 43, a work to elastically deform the holding pieces 91 is easily carried out.

As described above, according to the charging device 41 of the present disclosure, the guide walls 89 are put between the bearing part 71 and the restriction part 73 of the bush 65. Accordingly, the restriction part 73 restricts the deformation of the guide walls 89 so that it becomes possible to inhibit the displacement of the charging roller 61.

Additionally, after the charging roller 61 is temporarily fixed to the case 67, the case 67 is assembled to the casing 51 of the drum unit 35. At this time, between the charging roller 61 and the photosensitive drum 39, the predetermined gap G is formed. Accordingly, when the case to which the charging roller 61 is temporarily fixed is slid along the rail plate 55 of the casing 51, the charging roller 61 and the bushes 65 are not interfered with the surface of the photosensitive drum 39. Therefore, it becomes possible to carry out the attachment work of the charging device 41 easily and to prevent the surface of the photosensitive drum 39 from being damaged during the attachment work.

Additionally, because the holding pieces 91 are elastically deformed at the middle of pushing the bushes 65 downward, the restriction part 73 of the bush 65 is automatically engaged with the holding pieces 91 of the case 67 to temporarily fix the bush 65 to the case 67. In order to release the engagement of the restriction part 73 with the holding pieces 91, it is required to elastically deform the holding pieces 91. Accordingly, it becomes possible to easily carry out a work to temporarily fix the bush 65 and to release the temporary fixing.

In the present embodiment, the claw 93 of the holding piece 91 is engaged with the restriction part 73 of the bush 65 to fix the bush 65 temporarily; the claw 93 may be engaged with the bearing part 71 of the bush 65. The present embodiment describes a configuration that the charging device 41 is slid along the axial direction of the rotation shaft of the photosensitive drum 39 and then assembled to the casing 51. However, in a case where the charging device 41 is assembled to the casing 51 in another way, if the bush 65 to which the charging roller 61 is supported is temporarily fixed, it becomes possible to carry out an assembling work of the charging device 41 to the casing 51 easily.

The present embodiment describes the charging device 41 of the contact charging type in which the charging roller 61 comes into contact with the surface of the photosensitive drum 39 to charge the surface. However, the present embodiment may be applied to the charging device of a short-range discharging type in which the charging roller faces the surface of the photosensitive drum via a small air gap and the discharge is produced between the charging roller and the photosensitive drum. In this case, when the holding pieces 91 are elastically deformed inwardly, the bushes 65 are biased upward by the coil springs 69 and the charging roller 61 faces the photosensitive drum 39 with the small air gap.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A charging device comprising:

a charging roller configured to come into contact with or be close to a surface of an image carrier and configured to charge the surface of the image carrier;

a bush configured to support an end portion of the charging roller in a rotatable manner; and a case to which the end portion of the charging roller is attached along a predetermined attachment direction by the bush, wherein the case includes a pair of guide walls standing along the attachment direction so as to guide the bush, and the bush includes a bearing part and a restriction part, wherein the end portion of the charging roller is inserted into the bearing part, and the pair of guide walls is put between the bearing part and the restriction part, the restriction part has a base piece fixed to the bearing part and a pair of arm pieces bent at right angles from both end portions of the base piece and facing the bearing part via a predetermined interval, and the pair of guide walls is put between the bearing part and the pair of arm pieces.

2. The charging device according to claim 1, further comprising:

a biasing member configured to bias the bush in a direction in which the charging roller comes into contact with the surface of the image carrier, and an elastically deformable holding piece configured to hold the bush at a temporary fixed position where the charging roller is separated from the surface of the image carrier.

3. The charging device according to claim 2, wherein the holding piece includes a claw engageable with the restriction part, when the claw is engaged with the restriction part, the bush is held at the temporary fixed position, and when the claw is elastically deformed to release the engagement of the claw with the restriction part, the bush is biased by the biasing member such that the charging roller comes into contact with or is close to the surface of the image carrier.

4. The charging device according to claim 1, further comprising a cleaning roller configured to clean a surface of the charging roller, wherein the bush includes a bearing part into which an end portion of the cleaning roller is inserted.

5. A drum unit comprising:

the image carrier;

the charging device according to claim 3; and a casing by which the image carrier and the charging device are supported, wherein the charging device is attached to the casing along a rotation axis direction of the image carrier while the bush is held at the temporary fixed position, then, when the engagement of the claw with the restriction part is released, the bush is biased by the biasing member such that the charging roller comes into contact with or is close to the surface of the image carrier.

6. An image forming apparatus comprising:

the drum unit according to claim 5; and a toner image forming part configured to form a toner image on the image carrier.

* * * * *